US009746807B2

(12) United States Patent
Nishioka

(10) Patent No.: US 9,746,807 B2
(45) Date of Patent: Aug. 29, 2017

(54) SHEET FEED CASSETTE THAT REGULATES POSITIONAL DISPLACEMENT OF SHEET AND IMAGE FORMING APPARATUS INCLUDING THE SAME

(71) Applicant: KYOCERA Document Solutions Inc., Osaka (JP)

(72) Inventor: Nobuhiro Nishioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/204,532

(22) Filed: Jul. 7, 2016

(65) Prior Publication Data

US 2017/0031290 A1 Feb. 2, 2017

(30) Foreign Application Priority Data

Jul. 30, 2015 (JP) ..... 2015-150382

(51) Int. Cl.

| | |
|---|---|
| ***B65H 1/26*** | (2006.01) |
| ***B65H 1/04*** | (2006.01) |
| ***G03G 15/00*** | (2006.01) |

(52) U.S. Cl.

CPC ..... *G03G 15/6502* (2013.01); *B65H 1/04* (2013.01); *B65H 1/266* (2013.01); *B65H 2405/112* (2013.01); *B65H 2405/1122* (2013.01); *B65H 2511/10* (2013.01); *B65H 2511/12* (2013.01); *G03G 2215/00383* (2013.01)

(58) Field of Classification Search

CPC ..... B65H 1/04; B65H 1/266; B65H 2511/12; B65H 2405/112; B65H 2405/1122

See application file for complete search history.

(56) References Cited

U.S. PATENT DOCUMENTS 8,632,066 B2 * 1/2014 Nakamura ..... B65H 1/266 271/171

FOREIGN PATENT DOCUMENTS

| | | | |
|---|---|---|---|
| JP | 2004123292 A | * | 4/2004 |
| JP | 2005-231862 A | | 9/2005 |
| JP | 2010173780 A | * | 8/2010 |

* cited by examiner

*Primary Examiner* — Luis A Gonzalez
(74) *Attorney, Agent, or Firm* — Stein IP, LLC

(57) ABSTRACT

A sheet feed cassette includes a bottom portion, a first cursor, a second cursor, and a fixing rack. The second cursor includes a regulating member, a lock member, and a biasing member. The regulating member abuts on the rear end edge of the sheet to regulate a position of the sheet in the mounting direction. The lock member includes a shaft portion extending in a direction intersecting with the mounting direction and an engaging protrusion located below the shaft portion. The biasing member is located and compressed between the regulating member and the lock member above the shaft portion. The gear teeth of the fixing rack and the engaging protrusion of the lock member engage so as to lock a position of the second cursor in the mounting direction. The regulating member and the lock member are separated above the shaft portion in the locked state.

5 Claims, 12 Drawing Sheets

SHEET FEED CASSETTE THAT REGULATES POSITIONAL DISPLACEMENT OF SHEET AND IMAGE FORMING APPARATUS INCLUDING THE SAME

INCORPORATION BY REFERENCE

This application is based upon, and claims the benefit of priority from, corresponding Japanese Patent Application No. 2015-150382 filed in the Japan Patent Office on Jul. 30, 2015, the entire contents of which are incorporated herein by reference.

BACKGROUND

Unless otherwise indicated herein, the description in this section is not prior art to the claims in this application and is not admitted to be prior art by inclusion in this section.

As a typical image forming apparatus, there is known an image forming apparatus that includes a sheet feed cassette for storing sheets. The sheet feed cassette can be installed along a predetermined direction with respect to an apparatus main body of the image forming apparatus. This sheet feed cassette includes a sheet housing portion and a cursor, which regulates a sheet position. Since sheets of various sizes are stored in the sheet housing portion, the cursor is slidingly movable inside the sheet housing portion.

SUMMARY

A sheet feed cassette according to one aspect of the disclosure internally stores sheets. The sheet feed cassette is mounted along a predetermined mounting direction with respect to a housing. The sheet feed cassette includes a bottom portion, a first cursor, a second cursor, and a fixing rack. The first cursor is movable along the mounting direction on the bottom portion. The first cursor abuts on an lead end edge of the sheet in the mounting direction. The second cursor is movable along the mounting direction on the bottom portion. The second cursor abuts on an rear end edge of the sheet in the mounting direction. The fixing rack is located on the bottom portion so as to extend in the mounting direction. The fixing rack includes a plurality of gear teeth formed at a predefined pitch in the mounting direction. The fixing rack fixes a position of the second cursor in the mounting direction. The second cursor includes a regulating member, a lock member, and a biasing member. The regulating member abuts on the rear end edge of the sheet to regulate a position of the sheet in the mounting direction. The lock member includes a shaft portion extending in a direction intersecting with the mounting direction and an engaging protrusion located below the shaft portion. The lock member is supported by the regulating member turnably around the shaft portion. The biasing member is located and compressed between the regulating member and the lock member above the shaft portion. A biasing force of the biasing member gives the lock member a rotatory force around the shaft portion. The gear teeth of the fixing rack and the engaging protrusion of the lock member engage so as to lock a position of the second cursor in the mounting direction. The regulating member and the lock member are separated above the shaft portion in the locked state.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
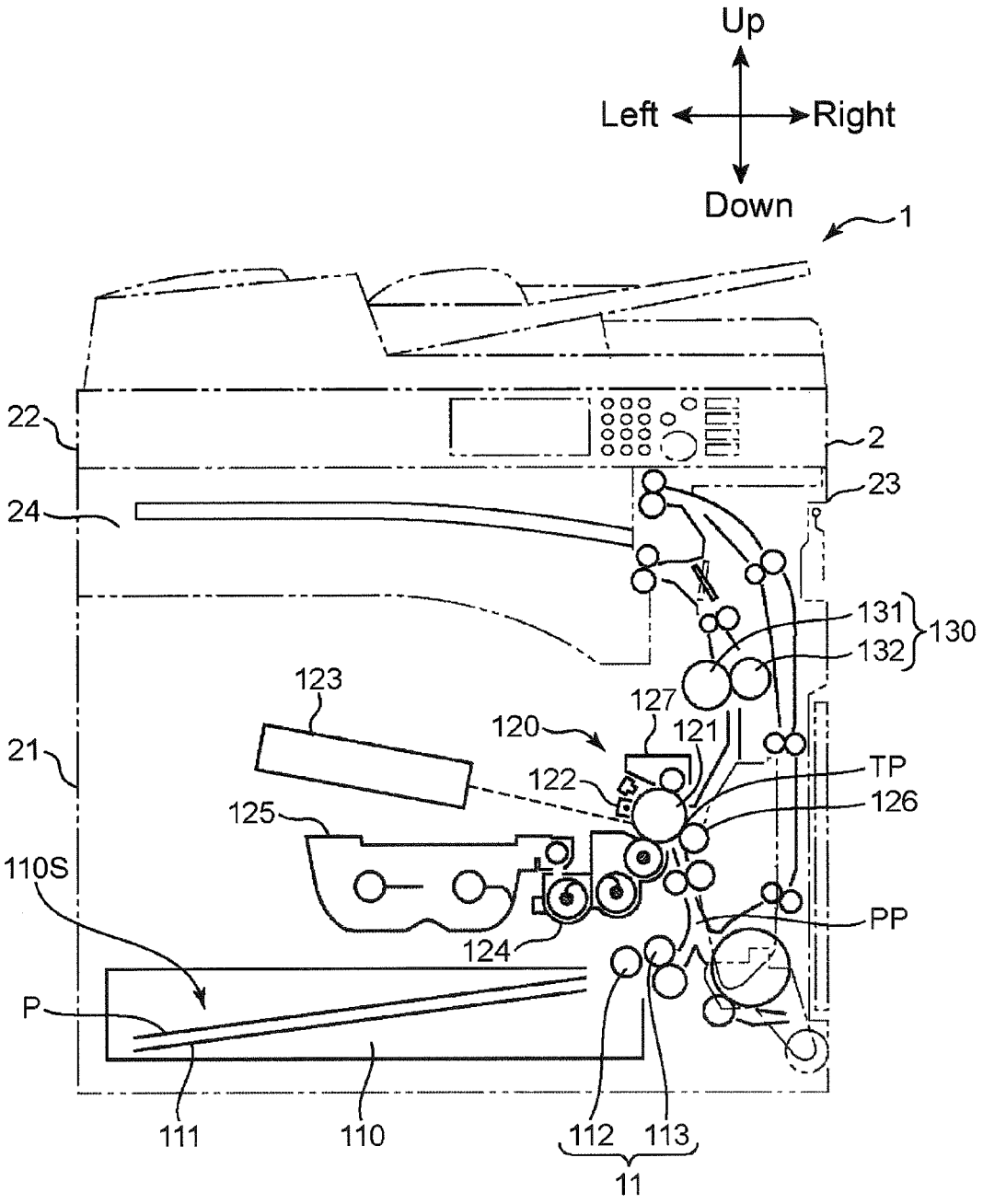
FIG. 1 is a cross section view of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be located, substituted, combined, separated, and designed in a wide variety of different configurations, all of which are explicitly contemplated herein.

The following describes one embodiment of the disclosure by referring to the accompanying drawings. FIG. 1 illustrates an internal cross section of an image forming apparatus 1 according to the one embodiment of the disclosure. While the image forming apparatus 1 illustrated in FIG. 1 is, so-called, a black-and-white printer, in other embodiments, the image forming apparatus may be a color printer, a facsimile device, a multi-functional peripheral having these functions, or other devices for forming a toner image on a sheet. In the following description, directional terms like "up," "down," "front," "rear," "left," and "right" are simply used for clarifying the description without limiting principles of the image forming apparatus. In the following description, the term of "sheet" means a copy paper, a coated paper, an OHP sheet, a cardboard, a postcard, a tracing paper, another sheet material subjected to an image formation process, or a sheet material subjected to any process other than the image formation process.

The image forming apparatus 1 includes a main chassis 2 that has an approximately rectangular parallelepiped shape. The main chassis 2 includes a lower chassis 21 (a housing), an upper chassis 22, and a connection chassis 23. The lower chassis 21 (the housing) has an approximately rectangular parallelepiped shape. The upper chassis 22, which has an approximately rectangular parallelepiped shape, is located on an upper side of the lower chassis 21. The connection chassis 23 connects the lower chassis 21 to the upper chassis 22. The lower chassis 21, the upper chassis 22, and the connection chassis 23 surround a discharge space 24. To the discharge space 24, a sheet on which a printing process is performed is discharged.

The image forming apparatus 1 includes a sheet feed cassette 110, a paper sheet feeder 11, and an image forming unit 120. The paper sheet feeder 11 includes a pickup roller 112 and a feed roller 113. The paper sheet feeder 11 feeds a sheet P rightward (in a conveyance direction) to a sheet conveyance path PP from the sheet feed cassette 110. The sheet conveyance path PP is a conveyance path located to pass through from the paper sheet feeder 11 to a transfer position TP located inside the image forming unit 120.

Into an inside of the sheet feed cassette 110, the sheets P are stored. The sheet feed cassette 110 is extracted from the lower chassis 21 to a front direction (a front side direction of the paper in FIG. 1), and can be mounted on the lower chassis 21 along a rear direction (a predetermined mounting direction). The sheet feed cassette 110 includes a lift plate 111, which supports the sheet P. The lift plate 111 is inclined to push up the leading edge of the sheet P toward the upper side.

The pickup roller 112 is located on the leading edge of the sheet P, which is pushed up by the lift plate 111 upward. When the pickup roller 112 rotates, the sheet P is extracted from the sheet feed cassette 110. The sheet P is fed in a paper feeding direction (rightward), which intersects with the mounting direction of the sheet feed cassette 110 inside the lower chassis 21. The feed roller 113 is located on the downstream side in the sheet conveyance direction of the pickup roller 112. The feed roller 113 sends out the sheet P to the further downstream side in the sheet conveyance direction.

The image forming unit 120 forms an image on the sheet P fed from the sheet feed cassette 110. The image forming unit 120 includes a photoreceptor drum 121, a charger 122, an exposure apparatus 123, a developing device 124, a toner container 125, a transfer roller 126, and a cleaning apparatus 127.

The photoreceptor drum 121 has a circumference surface on which an electrostatic latent image is to be formed, and carries the toner image corresponding to the electrostatic latent image. The charger 122 almost uniformly charges the circumference surface of the photoreceptor drum 121. The exposure device 123 irradiates a laser beam to the circumference surface of the photoreceptor drum 121. The developing device 124 supplies toner to the circumference surface of the photoreceptor drum 121. The toner container 125 supplies toner to the developing device 124. The supply of toner to the photoreceptor drum 121 by the developing device 124 causes development (visualization) of the electrostatic latent image formed on the circumference surface of the photoreceptor drum 121 so as to form a toner image. The transfer roller 126 transfers the toner image formed on the circumference surface of the photoreceptor drum 121 to the sheet P in the transfer position TP. The cleaning apparatus 127 removes the toner remaining on the circumference surface of the photoreceptor drum 121 after the toner image is transferred to the sheet P.

The image forming apparatus 1 further includes a fixing unit 130. The fixing unit 130 fixes the toner image on the sheet P, on the downstream side in the sheet conveyance direction with respect to the image forming unit 120. The fixing unit 130 includes a heating roller 131 and a pressure roller 132. The heating roller 131 melts the toner on the sheet P. The pressure roller 132 brings the sheet P into close contact with the heating roller 131.

Figure 2:
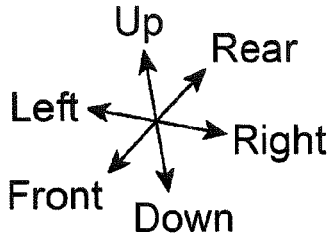
FIG. 2 is a perspective view of a sheet feed cassette according to the one embodiment.
Figure 2:
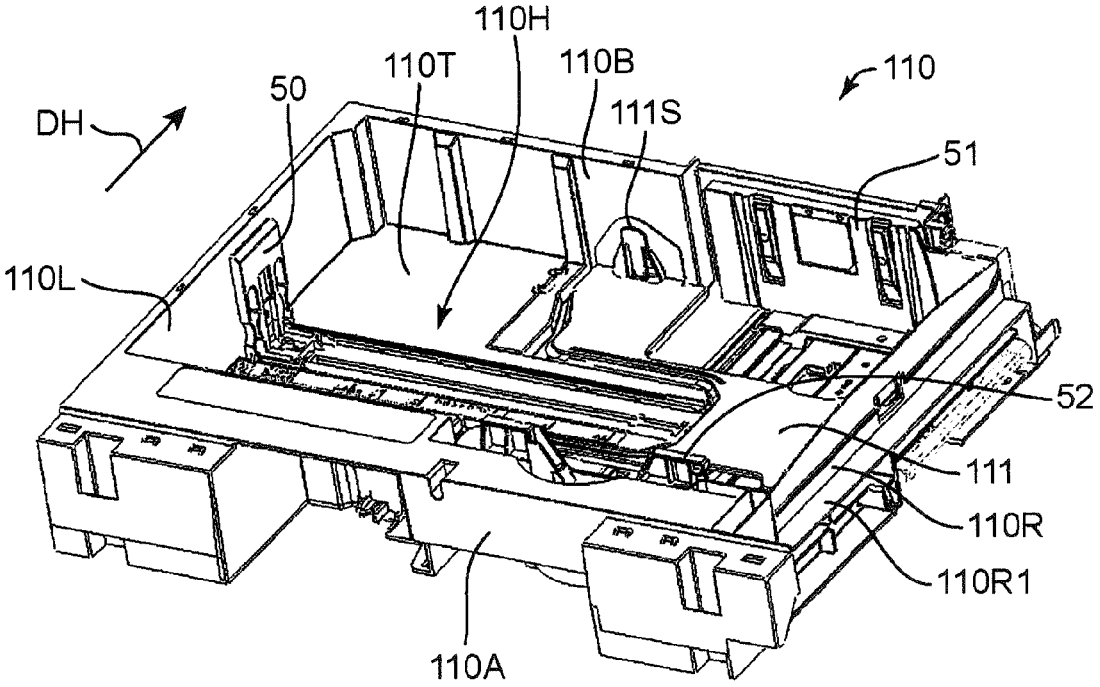
Figure 3:
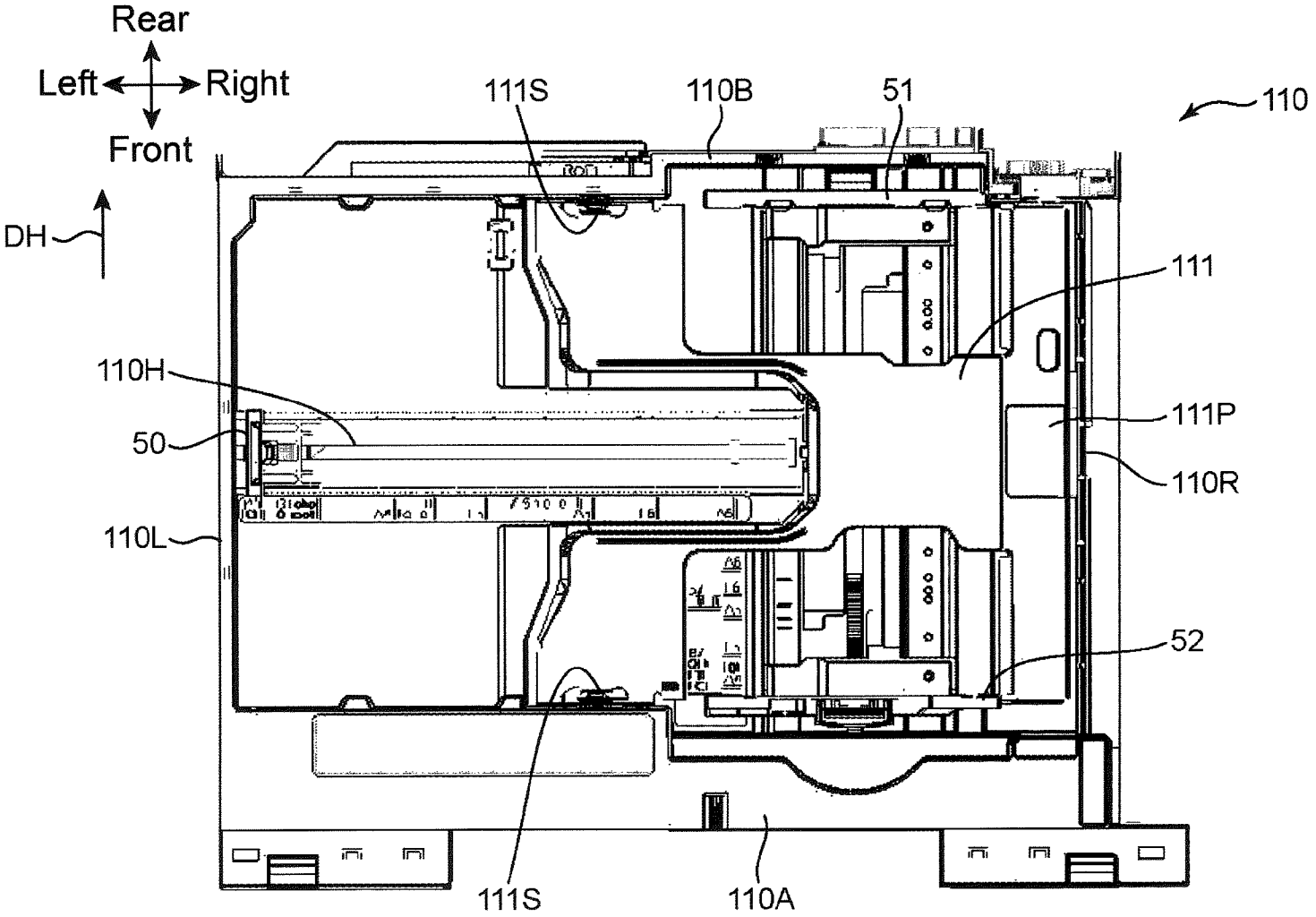
FIG. 3 is a plan view of the sheet feed cassette according to the one embodiment.
Figure 4:
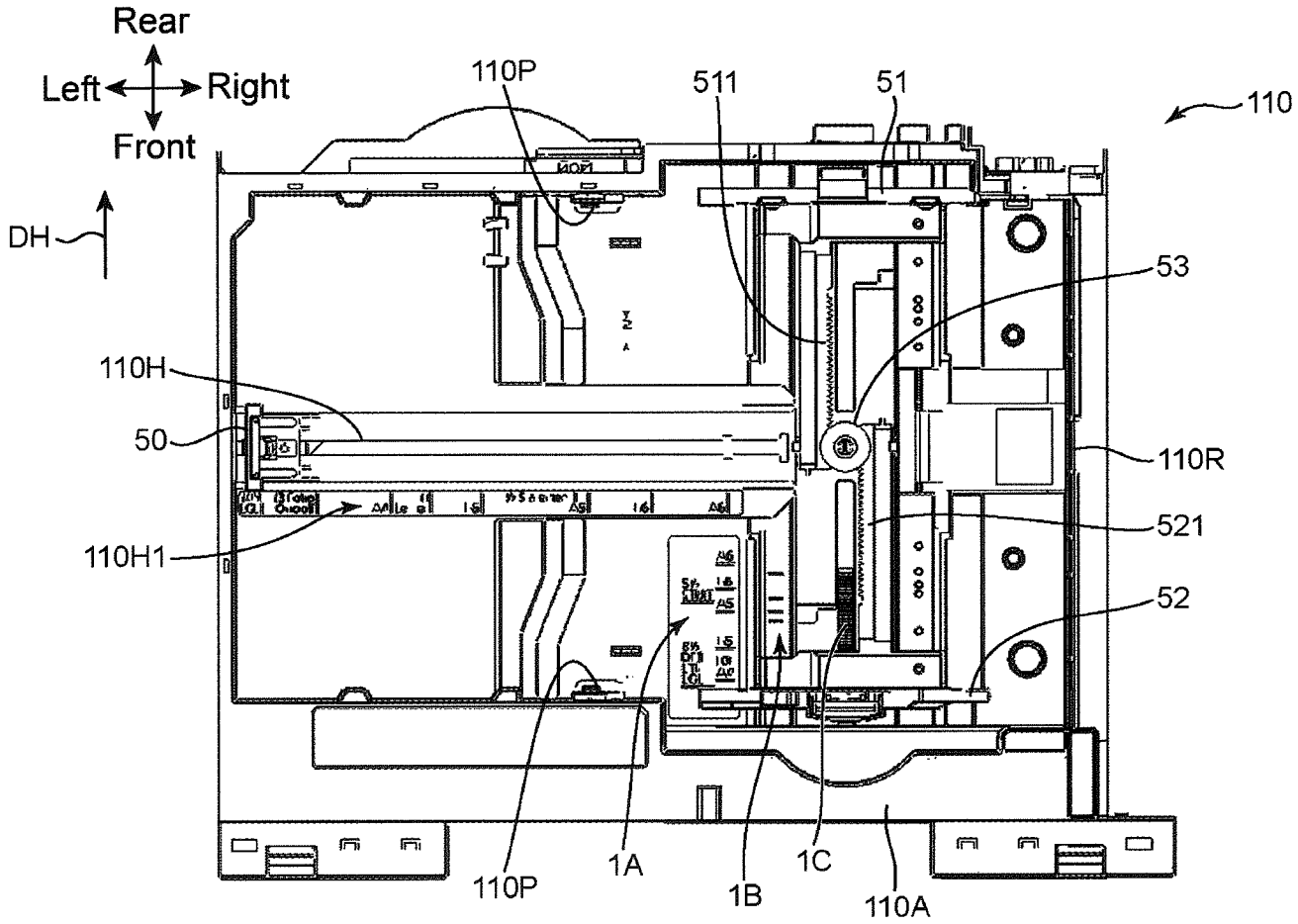
FIG. 4 is a plan view of the sheet feed cassette in a state where a lift plate is removed in FIG. 3 in a plan view.

Next, the sheet feed cassette 110 according to the embodiment will further be described. FIG. 2 obliquely illustrates the sheet feed cassette 110 according to the embodiment. FIG. 3 illustrates the sheet feed cassette 110 in a plan view. FIG. 4 illustrates a state where the lift plate 111 is removed from the sheet feed cassette 110 in FIG. 3 in a plan view.

With reference to FIG. 2, the sheet feed cassette 110 has an approximately rectangular parallelepiped shape and has a top surface opened. The sheet feed cassette 110 includes a cassette bottom portion 110T (a bottom portion), a cassette front wall 110A, a cassette rear wall 110B, a cassette right side wall 110R, and a cassette left side wall 110L. The cassette bottom portion 110T, which is a bottom portion of the sheet feed cassette 110, has a rectangular shape in plan view. From front, rear, left, and right side portion of the cassette bottom portion 110T, the cassette front wall 110A, the cassette rear wall 110B, the cassette left side wall 110L, and the cassette right side wall 110R are located upright respectively. Consequently, a sheet housing portion 110S (see FIG. 1) is formed inside the sheet feed cassette 110 to house the sheet P. In FIG. 2, on the front side of the cassette front wall 110A, a cassette cover (not illustrated) is mounted. The cassette right side wall 110R includes a right side rail 110R1. Similarly, the cassette left side wall 110L includes a left side rail (not illustrated). These rails guide mounting of the sheet feed cassette 110 on the lower chassis 21. In this case, the sheet feed cassette 110 is mounted on the lower chassis 21 in an arrow DH direction in FIG. 2 and FIG. 3.

The above-described lift plate 111 is turnable using a cassette shaft support portion 110P (see FIG. 4) as a fulcrum. The cassette shaft support portion 110P is disposed projecting from the cassette front wall 110A and the cassette rear wall 110B. The cassette shaft support portion 110P is inserted through a hole-shaped lift plate fulcrum 111S (see FIG. 2 and FIG. 3) opened in the lift plate 111. The lift plate 111 includes a pad member 111P (see FIG. 3). The pad member 111P is an elastic member laminated on a right edge portion of the lift plate 111. The pad member 111P prevents a last paper and a sheet bundle near it from being multi-fed.

The sheet feed cassette 110 further includes a rear end cursor 50 and a rear end guiding portion 110H (see FIG. 2). The rear end cursor 50 regulates a rear end portion in the conveyance direction of the sheet housed in the sheet housing portion 110S. The rear end guiding portion 110H is a guide groove that extends in a lateral direction on the cassette bottom portion 110T. The rear end cursor 50 is movable in the conveyance direction of the sheet P along the rear end guiding portion 110H. The rear end guiding portion 110H includes the front side where a rear end size display 110H1, on which a size of the sheet P is displayed, is located (see FIG. 4).

The sheet feed cassette 110 includes a first cursor 51, a second cursor 52, and a pinion gear 53 (see FIG. 4). The first cursor 51, which is movable along the mounting direction of the sheet feed cassette 110 on the cassette bottom portion 110T, abuts on an lead end edge of the sheet P on a forward end side in the mounting direction. Similarly, the second cursor 52, which is movable along the mounting direction on the cassette bottom portion 110T, abuts on the rear end edge of the sheet Pin the mounting direction.

The first cursor 51 includes a first rack 511. The second cursor 52 includes a second rack 521. The first rack 511 and the second rack 521 extend from the first cursor 51 and the second cursor 52 respectively to an inside in a width direction of the sheet P. The first rack 511 and the second rack 521 include rack gears (see a moving rack gear 521G in FIG. 5A). These rack gears are engaged to the pinion gear 53 (see FIG. 4), which is rotatably located between the first cursor 51 and the second cursor 52. Consequently, the first cursor 51 and the second cursor 52 can interlock to slidingly move in the width direction (a front-rear direction) of the sheet P.

With reference to FIG. 4, the sheet feed cassette 110 includes a size display 1A, a standard-size groove portion 1B, and a fixing rack 1C. The size display 1A displays a plurality of sizes of the sheets P. When the second cursor 52 moves in the front-rear direction, one end of the second cursor 52 (a second cursor indication portion 521 in FIG. 7A) indicates a sheet size at a position of the size display 1A. Consequently, the size of the sheet P that the sheet housing portion 110S can house is recognized by a user.

The standard-size groove portion 1B includes a plurality of grooves 1B1 (see FIG. 7A), which are located at intervals in the front-rear direction on the right side of the size display 1A. These grooves, which have a predetermined length in the lateral direction each, are formed such that a part of the cassette bottom portion 110T is depressed. By a clicking feel when a standard-size projection piece 52C (see FIG. 5C), which will be described later, is inserted into the grooves 1B1 of the standard-size groove portion 1B, the user recognizes that the second cursor 52 has reached a predetermined position.

The fixing rack 1C is located so as to extend in the front-rear direction to the right side of the standard-size groove portion 1B on the cassette bottom portion 110T. The fixing rack 1C includes a plurality of gear teeth 1C1 (see FIG. 7B), which are formed continuously at a predefined pitch in the front-rear direction (the mounting direction). The fixing rack 1C has a function to fix a position of the second cursor 52 in the front-rear direction. As described above, the first cursor 51 and the second cursor 52 integrally move via the pinion gear 53. In view of this, if the position of the second cursor 52 is fixed by the fixing rack 1C, a position of the first cursor 51 is also spontaneously fixed.

Figure 5A:
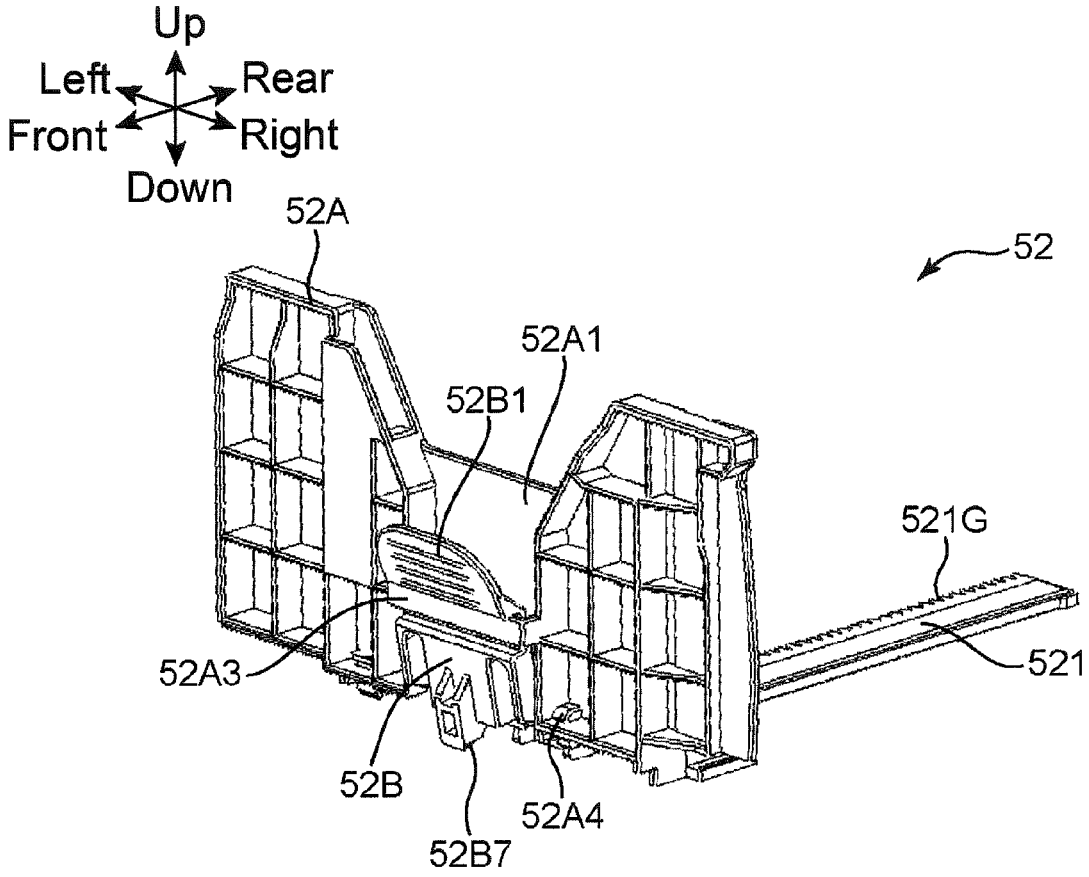
FIG. 5A is a perspective view of a second cursor of the sheet feed cassette according to the one embodiment.
Figure 5B:
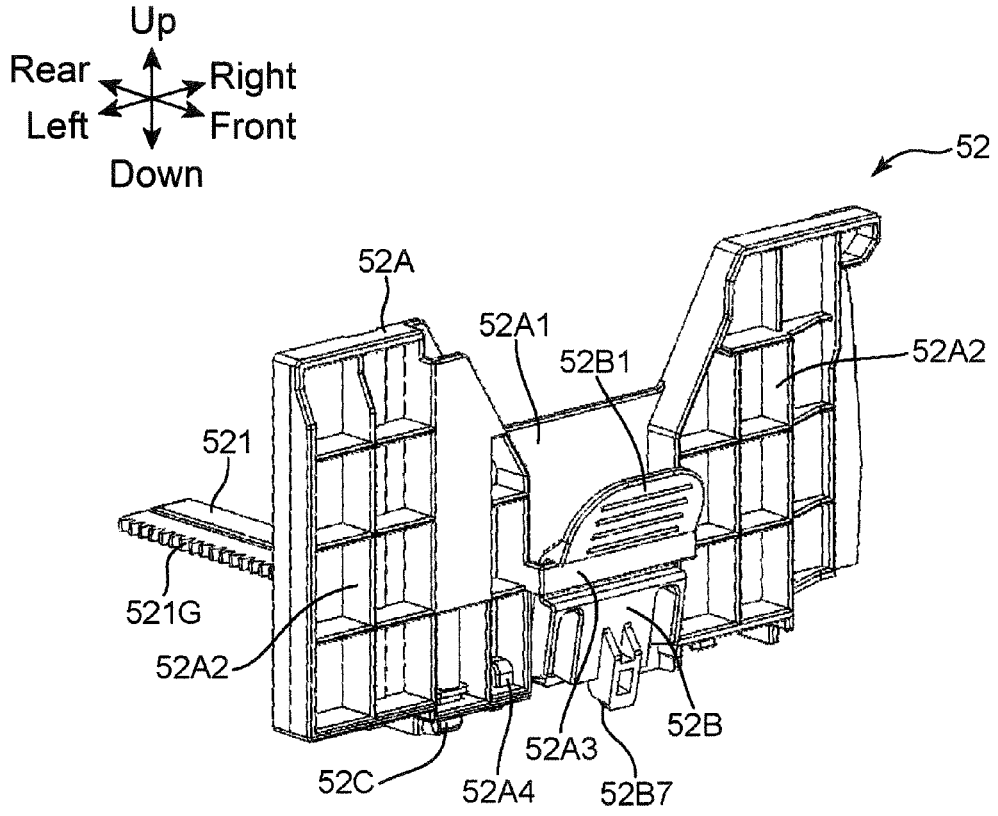
FIG. 5B is a perspective view of the second cursor of the sheet feed cassette according to the one embodiment.
Figure 5C:
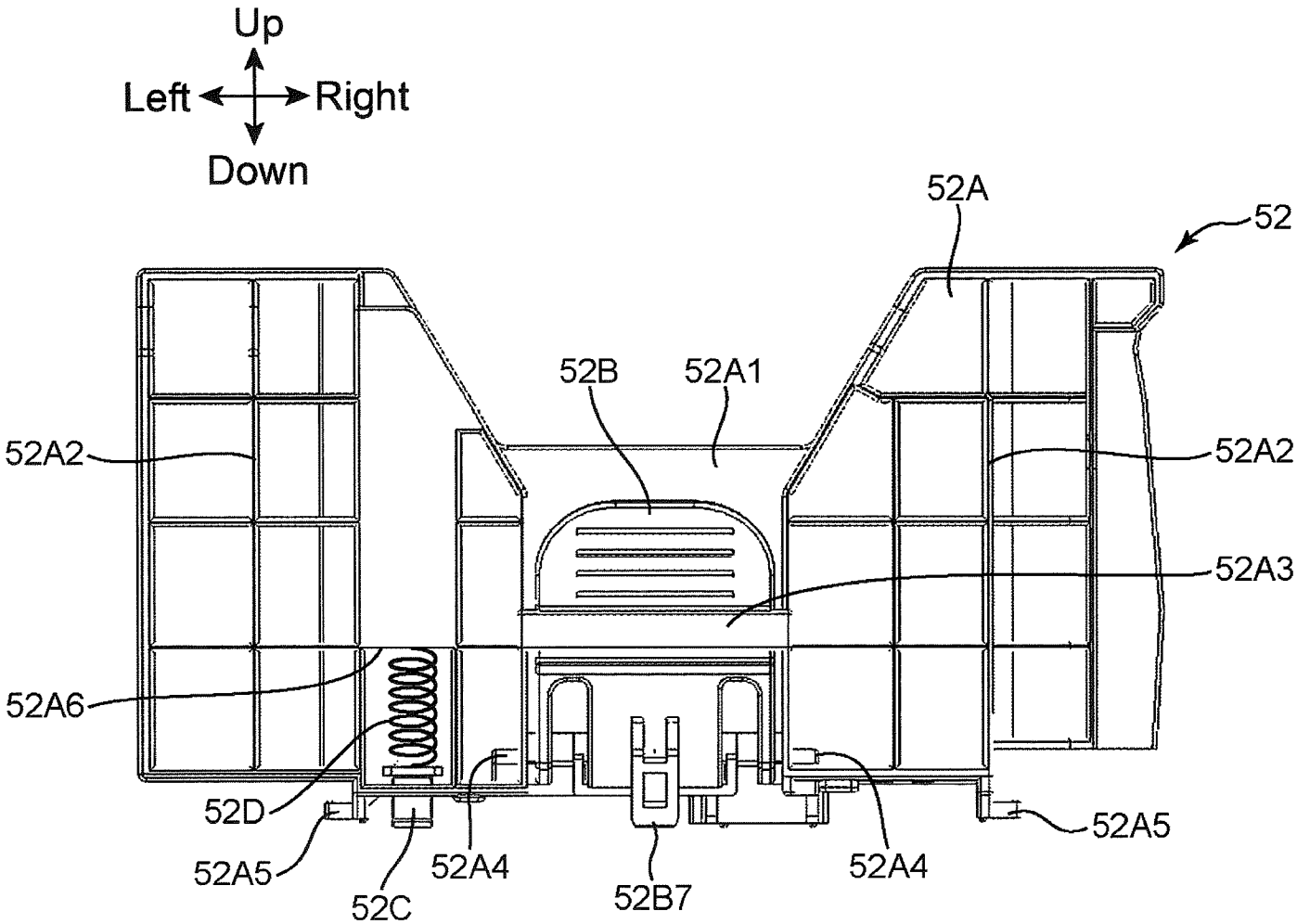
FIG. 5C is a front view of the second cursor of the sheet feed cassette according to the one embodiment.
Figure 6A:
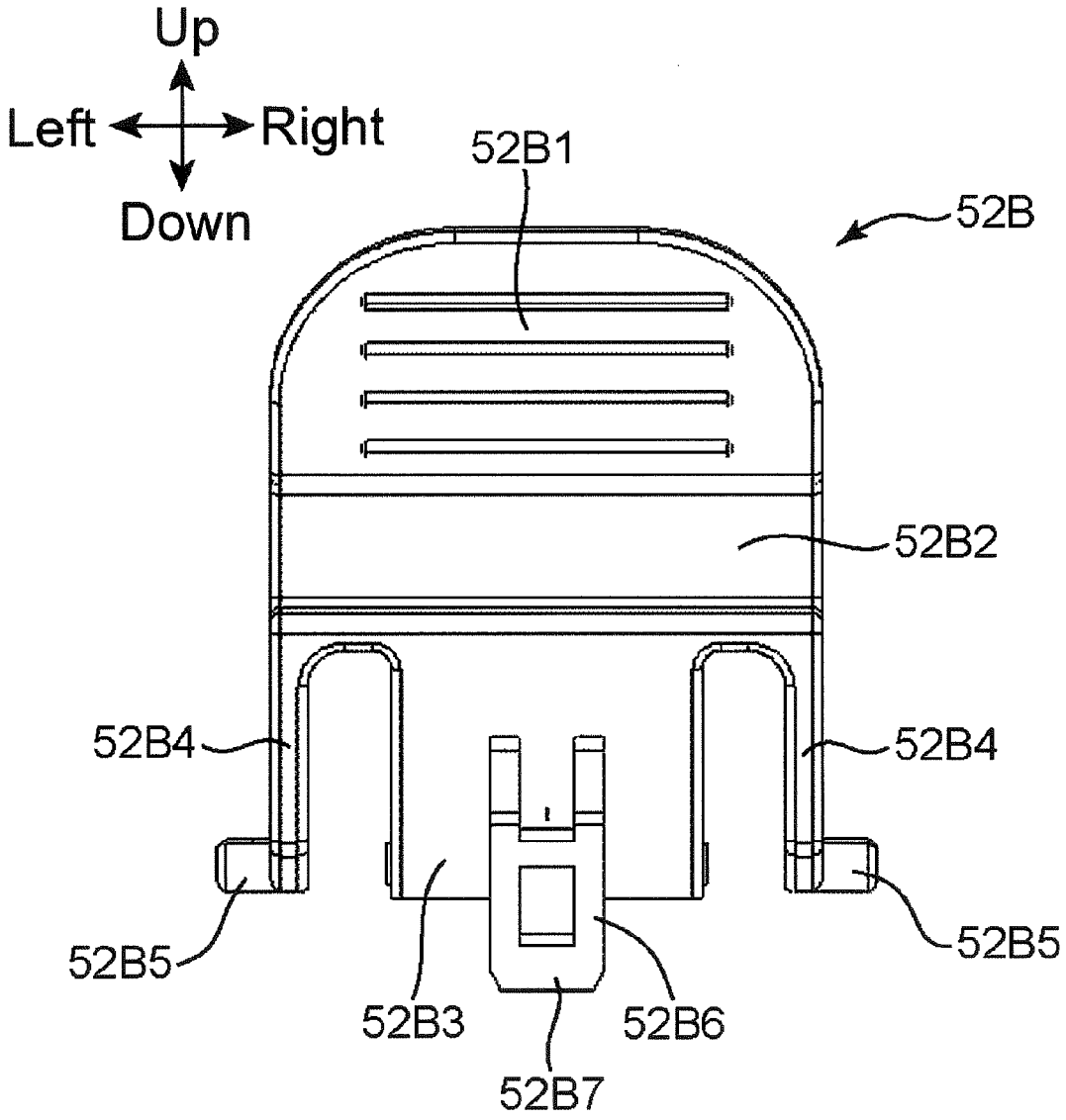
FIG. 6A is a front view of a lock member of the sheet feed cassette according to the one embodiment.
Figure 6B:
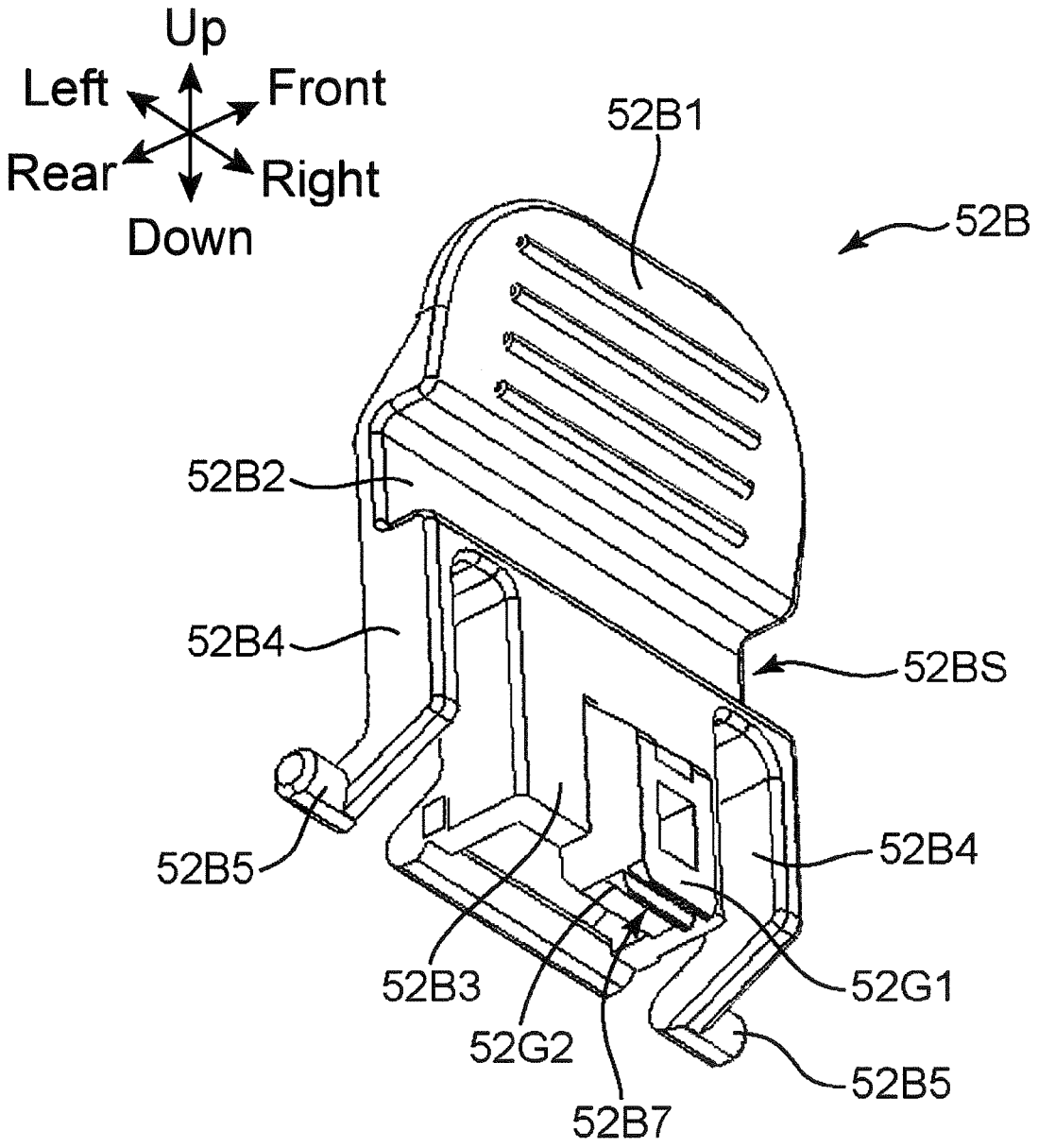
FIG. 6B is a perspective view of the lock member of the sheet feed cassette according to the one embodiment.
Figure 6C:
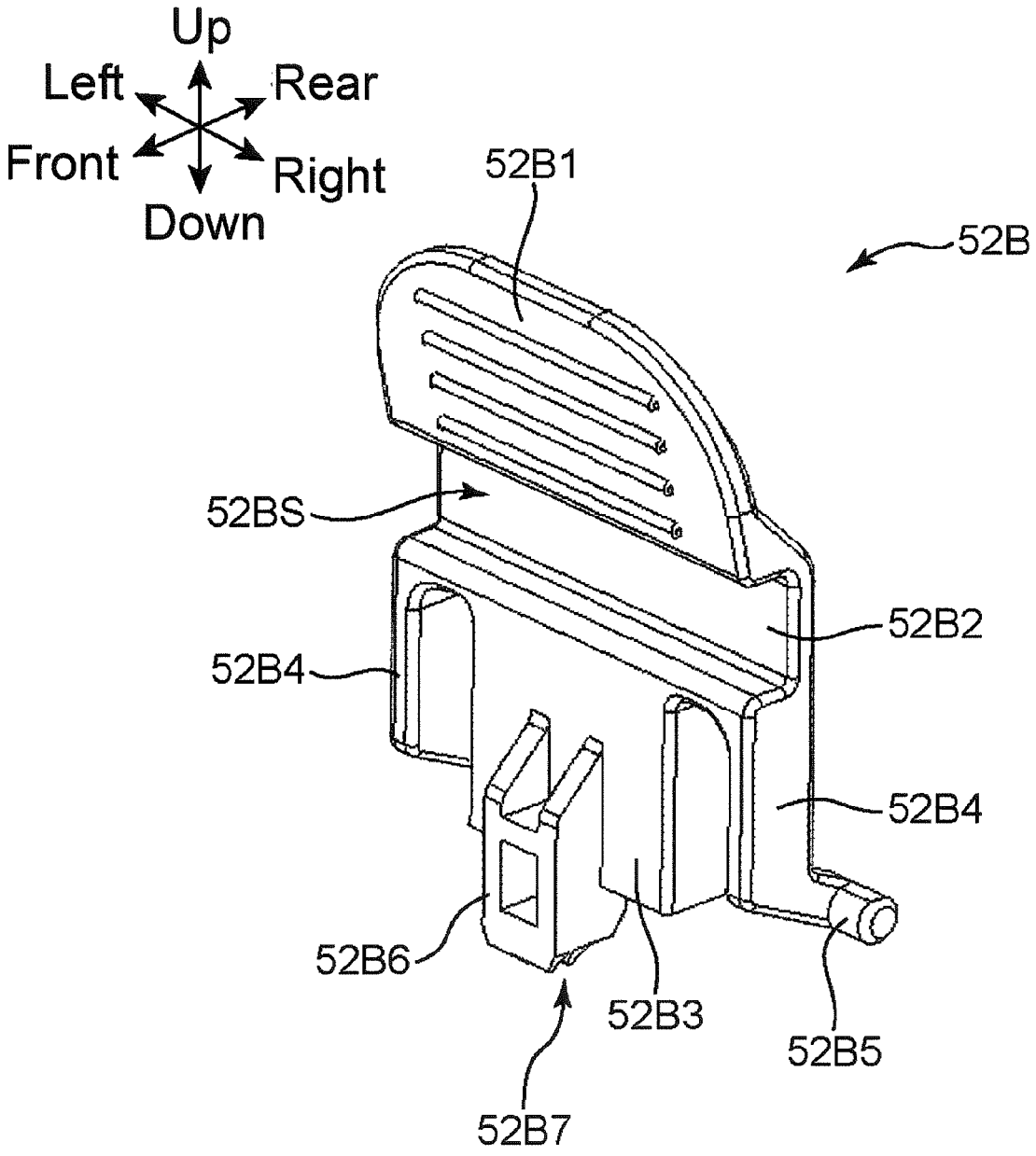
FIG. 6C is a perspective view of the lock member of the sheet feed cassette according to the one embodiment.
Figure 7A:
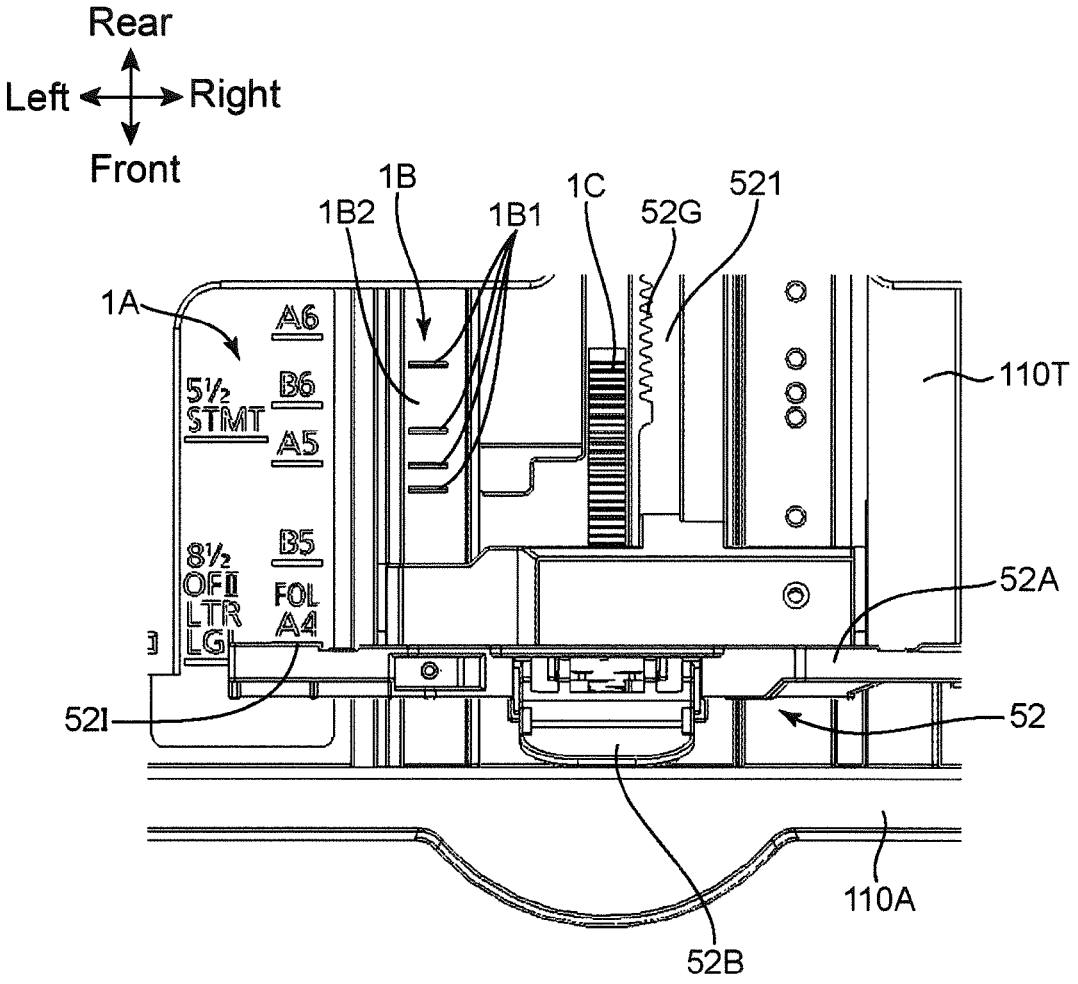
FIG. 7A is an enlarged plan view of a part of the sheet feed cassette according to the one embodiment.
Figure 7B:
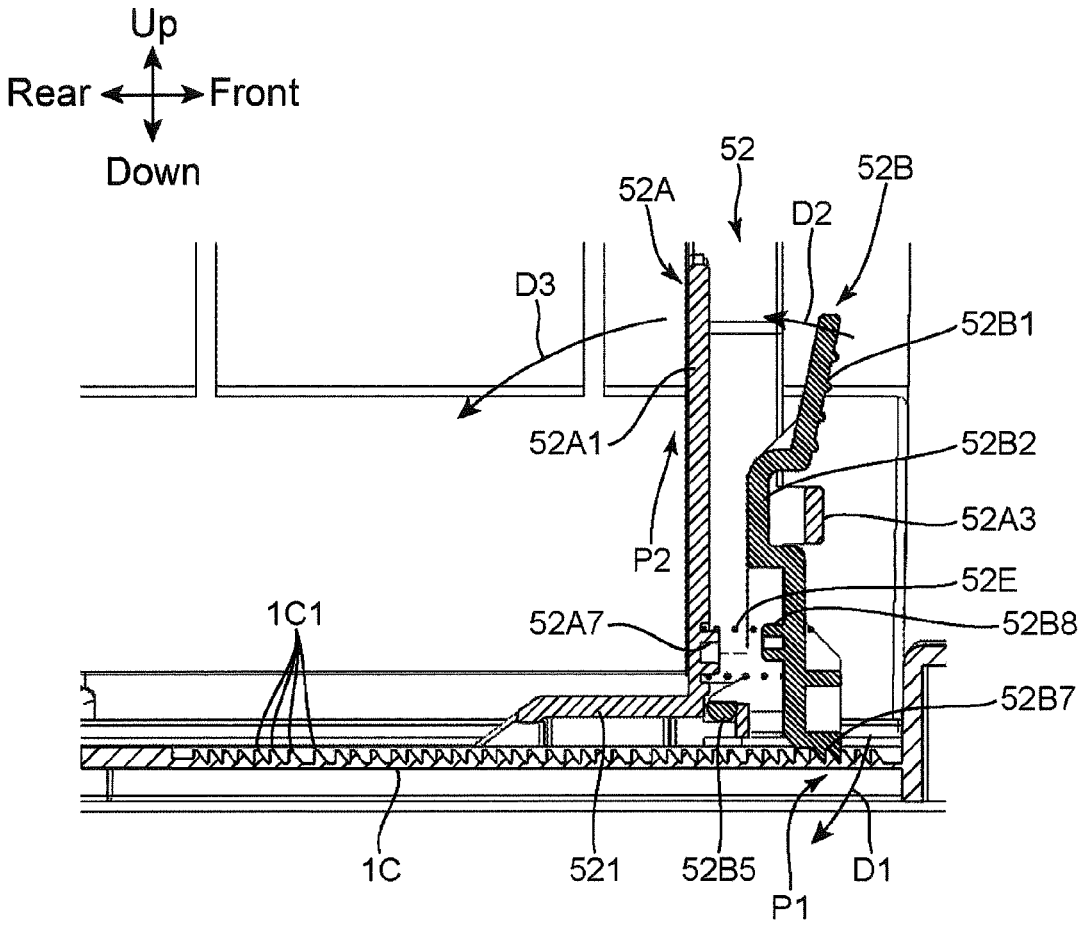
FIG. 7B is an enlarged cross section view of a part of the sheet feed cassette according to the one embodiment.

Next, the second cursor 52 according to the embodiment will further be described. FIGS. 5A and 5B obliquely illustrate the second cursor 52 according to the embodiment. FIG. 5C illustrates a front view of the second cursor 52. FIG. 6A illustrates a front view of a lock member 52B, which is a part of the second cursor 52. FIGS. 6B and 6C obliquely illustrate the lock member 52B. FIG. 7A illustrates a part of the sheet feed cassette 110 in an enlarged plan view. FIG. 7B illustrates an enlarged cross section of a part of the sheet feed cassette 110.

The second cursor 52 includes a regulating member 52A, the lock member 52B, the standard-size projection piece 52C (see FIGS. 5B and 50), a projection piece pressing spring 52D (see FIG. 5C), and a lock biasing spring 52E (see FIG. 7B) (a biasing member). The regulating member 52A, which abuts on the end edge of the sheet P to regulate a position in the width direction of the sheet P (the mounting direction of the sheet feed cassette 110), is a main part of the second cursor 52. As illustrated in FIG. 5A, the above-described second rack 521 runs from a lower end portion of the regulating member 52A backward. The regulating member 52A includes a regulate plate 52A1 (a regulating portion), a rib 52A2, an opposed bar 52A3 (a facing portion), shaft support holes 52A4, guide pieces 52A5, a spring housing space 52A6, and a first spring lock portion 52A7 (see FIG. 7B).

The regulate plate 52A1 is a plate-shaped member that extends in a vertical and the lateral direction. The regulate plate 52A1 includes a side surface on a rear side, which abuts on the end edge of the sheet P. As illustrated in FIG. 5C, on viewing from front, the regulate plate 52A1 is formed of a shape where an upper end center portion of a rectangular shape is cut out to an approximately trapezoidal shape. The rib 52A2 is a rib formed in a grid pattern on the front side of the regulate plate 52A1 (back side surface of a regulating surface of the regulating member 52A). The rib 52A2 enhances rigidity of the regulate plate 52A1.

The opposed bar 52A3 is an elongated piece connected to the regulate plate 52A1. The opposed bar 52A3 extends in the lateral direction opposing a center portion of the regulate plate 52A1. The opposed bar 52A3 includes both end portions connected to a part of the rib 52A2. The opposed bar 52A3 is located on the rear end side (the front side) in the mounting direction of the sheet feed cassette 110 with respect to the regulate plate 52A1. The opposed bar 52A3 is located so as to sandwich the lock member 52B, which will be described later, with the regulate plate 52A1 to form a space portion where the lock member 52B can enter.

The shaft support holes 52A4 are a pair of hole portions formed on the regulate plate 52A1. Into the shaft support holes 52A4, shaft portions 52B5 of the lock member 52B are inserted. The guide pieces 52A5 are a pair of projection pieces located on a lower end edge of the regulate plate 52A1. The pair of guide pieces 52A5 each project outside in the lateral direction. Inserting the guide pieces 52A5 into guide grooves (not illustrated) formed on the cassette bottom portion 110T guides a move in the front-rear direction of the second cursor 52.

The spring housing space 52A6 (see FIG. 5C) is formed of a wall surface defined by a part of the rib 52A2. The spring housing space 52A6 includes a top surface that supports an upper end portion of the projection piece pressing spring 52C. The first spring lock portion 52A7 (see FIG. 7B) is a protrusion located on the center portion in the lateral direction on a front side wall surface of the regulate plate 52A1. In FIGS. 5A to 5C, the first spring lock portion 52A7 does not appear because the first spring lock portion 52A7 is covered with the lock member 52B. On the first spring lock portion 52A7, one end of the lock biasing spring 52E, which will be described later, is engaged.

The lock member 52B is a member to mount on the regulating member 52A, and is removable from the sheet feed cassette 110 integrally with the regulating member 52A. The lock member 52B includes a function to lock the position of the second cursor 52. With reference to FIGS. 6A to 6C, the lock member 52B includes a clasp portion 52B1, a stepped portion 52B2, a center supporting portion 52B3, leg portions 52B4, the shaft portions 52B5, a center protrusion 52B6, engaging protrusions 52B7 and a second spring lock portion 52B8 (see FIG. 7B).

As illustrated in FIG. 5A, the lock member 52B is a center portion of the regulating member 52A in the lateral direction, and is mounted on the front side (the back side) of the regulate plate 52A1. The clasp portion 52B1 is formed of a tongue shaped portion located on an upper end portion of the lock member 52B. When the user of the sheet feed cassette 110 slidingly moves the second cursor 52, the user clasps the clasp portion 52B1 together with the regulate plate 52A1. The clasp portion 52B1 is located above the above-described opposed bar 52A3. The stepped portion 52B2 is positioned below the clasp portion 52B1, and is located to have a step backward with respect to the clasp portion 52B1. Consequently, as illustrated in FIGS. 6B and 6C, on the front side of the stepped portion 52B2, a concave portion 52B5 is formed. The concave portion 52B5 is located to face the opposed bar 52A3. The center supporting portion 52B3 extends downward from the center portion of the stepped portion 52B2 in the lateral direction. A pair of the leg portions 52134 are located to sandwich the center supporting portion 52B3, and each extend downward from both the end portions of the stepped portion 52B2 in the lateral direction. The shaft portions 52B5 are column-shaped shaft portions projecting toward outside in the lateral direction (a direction to intersect with the mounting direction of the sheet feed cassette 110) respectively from the lower end portions of the leg portions 52B4. The leg portions 52B4 are formed of a sheet-shaped member, and are elastically deformable in the lateral direction. In view of this, when the lock member 52B is mounted on the regulating member 52A, the shaft portions 52B5 are easily inserted into the shaft support holes 52A4 (see FIGS. 5A and 5B).

The center protrusion 52B6 (see FIG. 6C) is a protrusion portion that projects from the lower end side of the center supporting portion 52B3. The lower end portion of the center protrusion 52B6 includes the engaging protrusions 5267. The engaging protrusions 52B7 are located below the pair of the shaft portions 52B5. With reference to FIGS. 6B and 7B, the engaging protrusions 5267 include two engaging teeth adjacent at a predefined pitch in the front-rear direction. The respective two teeth include a side surface 52G1 (see FIG. 6B) on the front side (the rear end side in the mounting direction of the sheet feed cassette 110) and a side surface 52G2 (see FIG. 6B) on the rear side (the forward end side in the mounting direction). The side surface 52G1 extends in the vertical direction and the side surface 52G2 is formed of a inclined surface ascending toward its tip along the mounting direction of the sheet feed cassette 110 (see FIG. 7B). The second spring lock portion 52B8 (see FIG. 7B) is a protrusion that projects backward from a side surface of the rear side of the center supporting portion 52B3. On the second spring lock portion 52B8, a front end portion of the lock biasing spring 52E is engaged.

Inserting the shaft portions 52B5 of the lock member 52B into the shaft support holes 52A4 of the regulating member 52A (see FIGS. 5A and 5B) causes the lock member 52B to be supported by the regulating member 52A turnably around the shaft portions 52B5. At this time, as illustrated in FIGS. 5A to 5C, the stepped portion 52B2 of the lock member 52B is located between the regulate plate 52A1 and the opposed bar 52A3. Furthermore, above the opposed bar 52A3, the clasp portion 52B1 of the lock member 52B inclines such that the end ascends forward. The opposed bar 52A3 partially fits the concave portion 52B5 (see FIG. 6B) of the lock member 52B.

The standard-size projection piece 52C (see FIGS. 5B and 5C) is a projection piece supported by the regulating member 52A on the left side of the lock member 52B. For details, the standard-size projection piece 52C is inserted into a slit (not illustrated) formed on an inferior surface of the spring housing portion 52A6 (see FIG. 5C). On the upper end portion of the standard-size projection piece 52C, the lower end portion of the projection piece pressing spring 52D is engaged. Consequently, the standard-size projection piece 52C is slidingly movable in the vertical direction. The projection piece pressing spring 52D biases the standard-size projection piece 52C downward. By the biasing force of the projection piece pressing spring 52D, the standard-size projection piece 52C can enter the grooves 1B1 (see FIG. 7A) of the standard-size groove portion 1B of the sheet feed cassette 110. In the grooves 1B1, tapered surfaces (inclined surfaces) (not illustrated) are formed. In view of this, by the moving force when an operator slidingly moves the second cursor 52, the standard-size projection piece 52C can come out of the grooves 1B1 along the above-described tapered surfaces while compressing the projection piece pressing spring 52D.

The lock biasing spring 52E (see FIG. 7B) is a compression spring that is located being compressed between the regulating member 52A and the lock member 52B above the shaft portions 52B5. The lock biasing spring 52E is located on a side of the shaft portions 52B5 (downward) with respect to the above-described opposed bar 52A3.

With reference to FIGS. 7A and 7B, the second cursor 52 is slidingly movable in the front-rear direction in the sheet feed cassette 110. As illustrated in FIG. 7B, the lock biasing spring 52E biases the lock member 52B forward with respect to the regulating member 52A above the shaft portions 52B5. Consequently, the biasing force of the lock biasing spring 52E gives the lock member 52B a rotatory force around the shaft portions 52B5 (arrow D1 in FIG. 7B), and the gear teeth 1C1 of the fixing rack 1C and the engaging protrusions 52B7 of the lock member 52B engage so as to fix the position in the front-rear direction of the second cursor 52.

On the other hand, When the user of the sheet feed cassette 110 clasps the regulating member 52A and the clasp portion 52B1 in FIG. 7B from above, the lock member 52B turns in the opposite direction from arrow D1 around the shaft portions 52B5 against the biasing force of the lock biasing spring 52E. Consequently, the engagement of the gear teeth 1C1 of the fixing rack 1C and the engaging protrusions 52B7 of the lock member 52B, that is, a lock of the second cursor 52, is released, and the second cursor 52 is movable in the front-rear direction. In view of this, by the user (operator) turning the lock member 52B, moving the second cursor 52 is easily achieved.

As described above, the cassette bottom portion 110T of the sheet feed cassette 110 includes the size display 1A and the standard-size groove portion 1B besides the fixing rack 1C for fixing the position of the second cursor 52 (see FIG. 7A). In FIG. 7A, the second cursor indication portion 521 that locates on the left end portion of the second cursor 52 indicates "A4 size" on the size display 1A. Although FIG. 7A does not illustrate, the standard-size projection piece 52C (see FIG. 5C) enters into one of the grooves 1B1 (see FIG. 7A) of the standard-size groove portion 1B on the lower side of the second cursor 52. The user can see the sheet size on the size display 1A to know the fixing position of the second cursor 52 while slidingly moving the second cursor 52 as described above. Additionally, by the clicking feel when the standard-size projection piece 52C (see FIG. 5C), which slidingly moves on a planar portion 1B2 (see FIG. 7A) of the standard-size groove portion 1B in association with the move of the second cursor 52, enters into the next groove 1B1, the user can recognize the fixing position of the standard-size of the second cursor 52. As illustrated in FIG. 7B, the fixing rack 1C has the gear teeth 1C1 formed continuously along the front-rear direction. In view of this, even when the sheet P of a non-standard-size, which is none of the standard-sizes indicated on the size display 1A, is housed in the sheet feed cassette 110, the end edge of the sheet P can be regulated by the first cursor 51 and the second cursor 52.

In this embodiment, the sheet feed cassette 110 is located such that the width direction of the sheet P that is regulated by the first cursor 51 and the second cursor 52 runs along the mounting direction of the sheet feed cassette 110. In view of this, if the user swiftly installs the sheet feed cassette 110 backward onto the lower chassis 21 (see FIG. 1), the first cursor 51 receives a direct impact backward by the sheet bundle, and the regulating member 52A of the second cursor 52, which is connected to the first cursor 51, easily falls over backward (arrow D3 in FIG. 7B). If the regulating member 52A and the lock member 52B are integrally fixed by a plurality of fixing portions, when the lock member 52B falls over together with the regulating member 52A, the engaging protrusions 52B7 are detached from the gear teeth 1C1 of the fixing rack 1C and the lock of the second cursor 52 is released. Especially, in this embodiment, an engaging position P1 (see FIG. 7B) where the gear teeth 1C1 of the fixing rack 1C and the engaging protrusions 52B7 of the lock member 52B engage is located on the rear end side (the front side) in the mounting direction of the sheet feed cassette 110 with respect to a regulating position P2 (see FIG. 7B) where the regulating member 52A regulates the end edge of the sheet P. In this case, the fall of the lock member 52B easily leads to the detachment (uplift) of the engaging protrusions 52B7. The erroneous detachment of the engaging protrusions 52B7 displaces the position of the second cursor 52 to cause the displacement of the position of the stored sheet P. Consequently, a failure in feeding the sheet P and an image displacement may be generated.

In this embodiment, in order to solve such a problem, the lock member 52B is supported by the regulating member 52A turnably around the shaft portions 52B5, thus in a state where the second cursor 52 is locked, the regulating member 52A and the lock member 52B are not in abutting contact (or separated) above the shaft portions 52B5. For details, as illustrated in FIG. 7B, there is no portion where the lock member 52B abuts on the regulating member 52A except for the portion where the pair of the shaft portions 52B5 are respectively supported by the shaft support holes 52A4 (see FIGS. 5A and 5B) in a state where the second cursor 52 is mounted on the sheet feed cassette 110. In view of this, even when the regulating member 52A falls over in the direction of arrow D3 in FIG. 7B while installing the sheet feed cassette 110, the lock member 52B is less likely to fall over and the engaging protrusions 52B7 are prevented from being detached from the gear teeth 1C1 of the fixing rack 1C. Accordingly, the release of the lock of the second cursor 52 caused by the impact of installing the sheet feed cassette 110 is prevented.

With reference to FIG. 7B, respective clearances are formed between the regulate plate 52A1 and the stepped portion 52B2 of the lock member 52B, and between the opposed bar 52A3 and the stepped portion 52B2 in a state where the gear teeth 1C1 of the fixing rack 1C and the engaging protrusions 52B7 of the lock member 52B engage. In view of this, even when the regulating member 52A falls over in the direction of arrow D3 in FIG. 7B, the opposed bar 52A3 is less likely to push the stepped portion 52B2 backward and the lock member 52B is prevented from falling over.

The lock biasing spring 52E (see FIG. 7B) is located on the side of the shaft portions 52B5 with respect to the opposed bar 52A3. In view of this, the operating force by the operator operating the second cursor 52 against the biasing force of the lock biasing spring 52E is reduced. Further, in a state where the second cursor 52 is locked, the opposed bar 52A3 is located within the concave portion 52B5, and the clasp portion 52B1 projects to the rear end side in the mounting direction with respect to the opposed bar 52A3. In view of this, a distance between the clasp portion 52B1 and the regulate plate 52A1 is set to be large in the locked state of the second cursor 52, and the operator can hold the clasp portion 52B1 and the regulate plate 52A1 easily. Thus, the operability of the second cursor 52 is improved.

Depending on the user, the user may not clasp the regulating member 52A and the lock member 52B simultaneously but only clasp the lock member 52B to move the second cursor 52. Even in such case, when the user tries to move the lock member 52B swiftly, the lock member 52B can abut on the regulate plate 52A1 or the opposed bar 52A3, and the move of the lock member 52B is regulated. Thus, without having a breakage of the engaging protrusions 52B7 and the shaft portions 52B5 slipping out of the shaft support holes 52A4, the second cursor 52 is prevented from breakage failures.

Removal of the second cursor 52 from the cassette bottom portion 110T (see FIG. 2) of the sheet feed cassette 110 upon a maintenance of the second cursor 52 and similar operations causes the lock member 52B to turn further around the shaft portions 52B5 to abut on the opposed bar 52A3 by the biasing force of the lock biasing spring 52E (see FIGS. 5A and 5B). That is, the opposed bar 52A3 functions as a rotation stopper of the lock member 52B. Consequently, detachment of the lock member 52B from the regulating member 52A is prevented, thus parts of the second cursor 52 are prevented from being lost.

The sheet feed cassette 110 and the image forming apparatus 1 according to the embodiment of the disclosure is described above. According to such a configuration, the position displacement of the second cursor 52 caused by the impact of installing the sheet feed cassette 110 is prevented. In view of this, the position of the sheet P is stably regulated so as to prevent the sheet P from being fed obliquely. Consequently, the sheet P can have an image stably formed thereon. The disclosure will not be limited to the embodiment, and, for example, the following modified embodiments can be employed.

(1) Although the above-described embodiment has described the aspect where the sheet P is fed in a direction intersecting with the mounting direction of the sheet feed cassette 110 inside the lower chassis 21, the disclosure will not be limited to this aspect. It may be the aspect where the sheet P is fed in a direction along the mounting direction of the sheet feed cassette 110. In this case, the sheet feed cassette 110 may not include the first cursor 51. Then, the second cursor 52 regulates the rear end position of the sheet P.

(2) Although the above-described embodiment has described the aspect where the regulating member 52A includes the opposed bar 52A3, the disclosure will not be limited to this aspect. The regulating member 52A may not include the opposed bar 52A3.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sheet feed cassette for internally storing sheets, the sheet feed cassette being mounted along a predetermined mounting direction with respect to a housing, the sheet feed cassette comprising:

a bottom portion;

a first cursor movable along the mounting direction on the bottom portion, the first cursor abutting on a lead end edge of the sheet in the mounting direction;

a second cursor movable along the mounting direction on the bottom portion, the second cursor abutting on a rear end edge of the sheet in the mounting direction; and a fixing rack located on the bottom portion so as to extend in the mounting direction, the fixing rack including a plurality of gear teeth formed at a predefined pitch in the mounting direction, the fixing rack fixing a position of the second cursor in the mounting direction, wherein the second cursor includes:

a regulating member that abuts on the rear end edge of the sheet to regulate a position of the sheet in the mounting direction;

a lock member that includes a shaft portion extending in a direction intersecting with the mounting direction and an engaging protrusion located below the shaft portion, the lock member being supported on the regulating member turnably around the shaft portion; and a biasing member located in a compressed state between the regulating member and the lock member above the shaft portion, wherein the regulating member includes:

a regulating portion that abuts on the rear end edge of the sheet; and a facing portion located on the rear end side with respect to the regulating portion in the mounting direction, so as to sandwich the lock member with the regulating portion in the mounting direction;

wherein a biasing force of the biasing member gives the lock member a rotatory force around the shaft portion, the gear teeth of the fixing rack and the engaging protrusion of the lock member engage so as to lock a position of the second cursor in the mounting direction, respective clearances are formed between the regulating portion and the lock member and between the facing portion and the lock member, in a state where the second cursor is locked, the regulating member and the lock member are separated above the shaft portion in the locked state, wherein the lock member includes:

a clasp portion located above the facing portion, the clasp portion being clasped when the lock member is turned around the shaft portions of the lock member; and a concave portion located to face the facing portion below the clasp portion, and wherein in a state where the second cursor is locked, the facing portion is located within the concave portion, the clasp portion projecting to the rear end side in the mounting direction with respect to the facing portion.

2. The sheet feed cassette according to claim 1, wherein the biasing member is located on a side of the shaft portion with respect to the facing portion.

3. The sheet feed cassette according to claim 1, wherein removal of the second cursor from the bottom portion causes the lock member to turn further around the shaft portions to abut on the facing portion by the biasing force of the biasing member.

4. The sheet feed cassette according to claim 1, wherein the sheet stored on the bottom portion is fed toward a direction intersecting with the mounting direction inside the housing.

5. An image forming apparatus, comprising:

the sheet feed cassette according to claim 1;

the housing; and an image forming unit located in the housing, the image forming unit forming an image on the sheet fed from the sheet feed cassette.

* * * * *